US007460051B2

(12) United States Patent
Näsvall et al.

(10) Patent No.: US 7,460,051 B2
(45) Date of Patent: Dec. 2, 2008

(54) RADAR REFLECTOR

(75) Inventors: Alf Näsvall, Sundbyberg (SE); Gunnar Byström, Kungsängen (SE)

(73) Assignee: SAAB AB, Linköping (SE)

( * ) Notice: Subject to any disclaimer, the term of this patent is extended or adjusted under 35 U.S.C. 154(b) by 232 days.

(21) Appl. No.: 11/356,077

(22) Filed: Feb. 17, 2006

(65) Prior Publication Data

US 2008/0266164 A1 Oct. 30, 2008

(30) Foreign Application Priority Data

Feb. 23, 2005 (EP) ..... 05445009

(51) Int. Cl.
*H01Q 17/00* (2006.01)

(52) U.S. Cl. ..... 342/7; 342/8; 342/10

(58) Field of Classification Search ..... 342/5–10
See application file for complete search history.

(56) References Cited

U.S. PATENT DOCUMENTS 3,138,798 A * 6/1964 Greenwood ..... 342/7

FOREIGN PATENT DOCUMENTS

GB 2378819 A 2/2003
GB 2378819 A * 2/2003

OTHER PUBLICATIONS

Search report issued in priority application EP05445009.3.

* cited by examiner

*Primary Examiner*—Thomas H. Tarcza
*Assistant Examiner*—Timothy A Brainard
(74) *Attorney, Agent, or Firm*—Venable LLP; Eric J. Franklin

(57) ABSTRACT

A radar reflector which can be deployed from an aircraft and is intended to fly freely after deployment, and which includes multiple reflector surfaces that are essentially plane in an operative state and which issue in pairs in opposite directions from an essentially plane base plane. The radar reflector before deployment can be stored compactly, packed up into the minimum possible volume. This facility for packing the radar reflector up has been achieved in that its reflecting main surfaces have each been divided up by means of specially aligned buckled folds into a plurality of parts which can be folded in towards one another when the reflector is to be folded up.

11 Claims, 2 Drawing Sheets

RADAR REFLECTOR

CROSS-REFERENCE TO RELATED APPLICATIONS

This application claims priority under 35 USC § 119 to European patent application no. 05445009.3 filed on 23 Feb. 2006.

FIELD OF THE INVENTION

The present invention relates to a new, improved type of radar reflector of the corner reflector type designed to be deployed from an aircraft in order to then function, either alone or with several together in the form of a cluster, as a free-flying dummy target.

BACKGROUND OF THE INVENTION

A marked advantage of the radar reflector according to the invention is that it can be folded up into a flat pack having a very small intrinsic volume, and that it can be stored in this state until deployed, whereupon it will be automatically unfolded, without the need for special opening elements, into a corner reflector of tried and tested design. The basic design of the radar reflector according to the invention is therefore previously known and it has the marked advantage that in its free flight it will tumble through the atmosphere and by virtue of its specific design will always create a dummy target, which although it may pulsate, will always be present.

The radar reflector according to the invention is therefore of the corner reflector type and is produced by bending and joining together an essentially plane radar wave-reflecting sheet material. By selecting a sheet material having a suitable shape memory for its manufacture, ingenious folding allows the radar reflector according to the invention to be made so that it can be folded up very compactly. At the same time, as soon as it leaves the packaging or the storage container keeping it in the folded state, it will automatically unfold to the desired shape without any separate opening elements whatsoever.

As already intimated, the radar reflector according to the invention in its open state has a thoroughly tried and tested basic shape, the good characteristics of which are well-known. This basic shape, which essentially comprises a square base plane bounded by four edge sides, along which the sheet material from which it is constructed is bent upwards or downwards relative to the extent of the base plane, this bending being done in the same direction on two of these adjoining edge sides and in the opposite direction along two opposing edge sides, said bends with the reflector in its opened state being made essentially at right-angles to the base plane and the sheet material along each such edge side continuing in the form of an essentially square reflector surface, whose own edge sides, in addition to the edge side along which the bending has been performed, constitute closing edges for the sheet material in the reflector, and adjoining closing edges of the edge material in said reflector surfaces bent upwards or downwards in the same direction being joined to one another along said adjoining closing edges, so that the reflector surfaces included therein together form a corner reflector.

Radar reflectors of this basic type are described in U.S. Pat. No. 3,138,798. This patent specification not only describes its good radar-reflecting characteristics and the advantages of its tumbling about in free flight in a manner advantageous for the radar wave reflection, but also notes that multiple such reflectors can in fact be nested one inside another, which means that it is possible to limit the volume occupied by a number of these reflectors nested one inside another. In addition, it also proposes that by rounding the exposed corners of the reflector surfaces it should be possible to accommodate a plurality of such nested reflectors in a spherical container capable of opening by dropping, which would thereby at the same time permit cluster dropping of a plurality of reflectors. Although the nesting and insertion of multiple reflectors in spherical containers described in the patent specification has certain advantages, this type of packing implies a requirement for large, empty spaces available in the carrier from which the reflectors are intended to be deployed.

SUMMARY OF THE INVENTION

According to the present invention it has now become possible to store corner reflectors of the type in question here in the form of folded, flat packs which are automatically opened when they leave the carrier deploying the reflectors. This has now been rendered possible in that the reflector surfaces, folded upwards or downwards from the base plane of the reflector and joined along their common edge surfaces, have been provided with an outwardly turned buckled fold, which extends in each reflector surface from the paired common inner corner of the reflector surfaces to the diagonally opposite outer corner of the particular essentially square reflector surface, and that each reflector surface, which in the opened state is essentially square, is also provided with a second inwardly turned buckled fold, which divides the part of each reflector surface situated between this first buckled fold and the common joint between the paired interacting reflector surfaces and divides this surface into two parts, which in the folded state overlap one another against the reflector. This second buckled fold then preferably divides the part of each reflector surface situated between said joint and the first buckled fold into two equal angles.

The bending scheme described above, which means that with the reflector folded up the main reflection surfaces of the reflector will consist of a number of overlapping parts tightly pressed against one another, will thus in terms of volume constitute a distinct improvement compared to the radar reflector previously described in U.S. Pat. No. 3,138,798, which despite its utilisation of the fact that the radar reflectors cab be nested, provides a product which requires a large storage volume, and according to which it is also necessary to sacrifice the exposed outer corners of the reflector surfaces in order to be able to make use of the spherical deployment container proposed therein, which is clearly detrimental to the radar reflection capability.

BRIEF DESCRIPTION OF THE DRAWINGS

The invention has been specified in more detail in the patent claims below and will now be described somewhat further with reference to drawings attached, in which:

DETAILED DESCRIPTION

Figure 1:
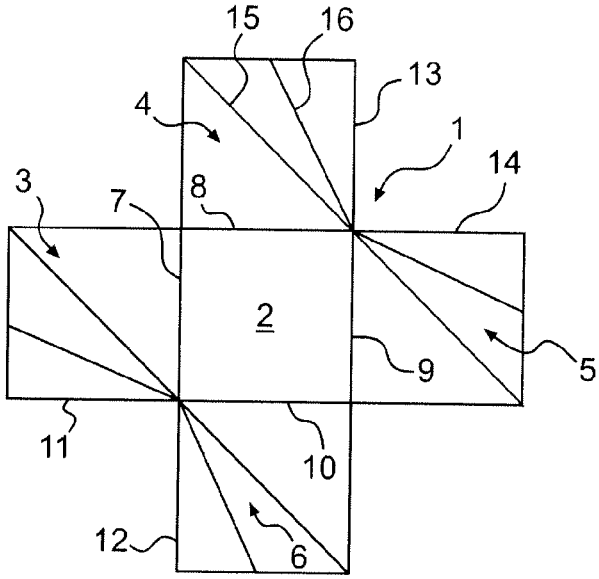
FIG. 1 on a small scale shows the basic material for a radar reflector of the type intended here.

Where they occur in the various drawings, all the components encountered have been given the same reference numerals regardless of the scales of the drawings.

Figure 2:
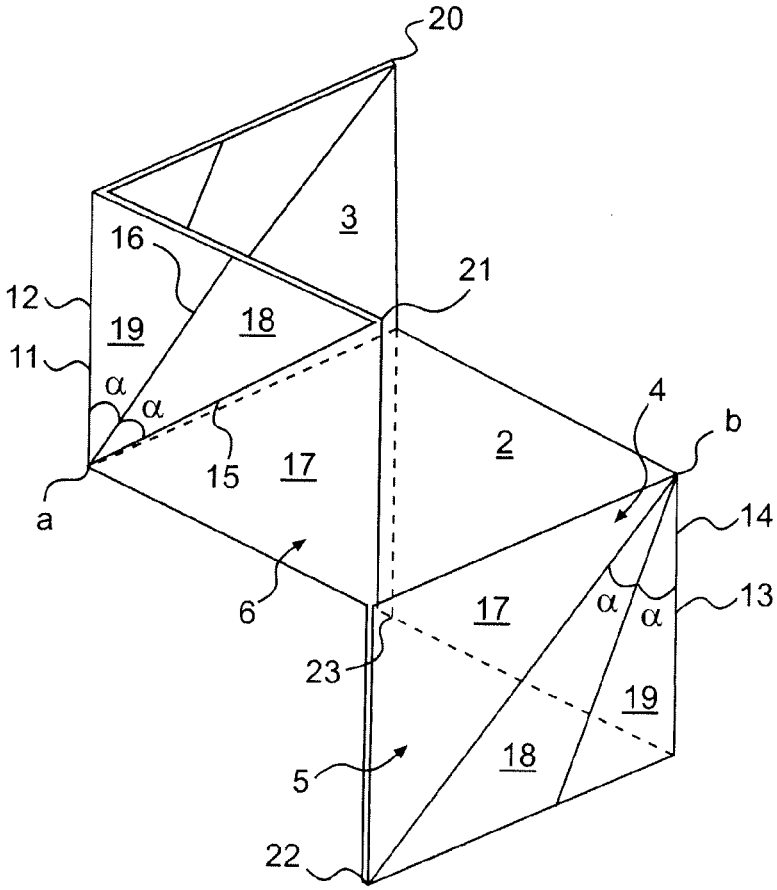
FIG. 2 shows the radar reflector on twice the scale in an opened, operative state.

The basic material for the manufacture of the radar reflector according to the invention is therefore the radar-reflecting sheet material shown in FIG. 1, which can be buckled and bent but which is otherwise dimensionally stable and has a good shape memory. This comprises the base plane 2 and the four reflector surfaces 3-6, which are joined to the base plane along their respective buckled folds 7-10. As will be seen from FIG. 2, the reflector surfaces 3 and 6 are bent upwards relative to the base plane 2 and joined to one another along their edge sides 11 and 12 adjoining one another in their upturned state, whilst the reflector surface 4 and 5 are bent downwards relative to the base plane 2 and are joined to one another along their respective edge sides 13 and 14 adjoining one another in the downturned state. The radar reflector according to the invention has thereby attained its operative shape shown in FIG. 2.

The radar-reflecting sheet material 1 used for manufacturing the radar reflector characterizing the invention has already been provided in the preparatory production stage shown in FIG. 1 with the buckled folds which will permit the complete folding up of the radar reflector. These buckled folds mean that a first outwardly turned buckled fold, which extends from the common inner corners a and b of the interacting reflector surfaces out to the outer exposed corners 20-23 of the reflector surfaces, has been formed in each reflector surface bent up or down relative to the base plane. This buckled fold has been given the general designation 15 in all the figures. The part of each such reflector surface that is bounded by said first buckled fold 15 and the connecting edge 11-14 of each reflector surface with the adjoining reflector surface 3-6 is further divided along equal angles $\alpha$ along a second inturned buckled fold 16, which issues from the same common inner corner a or b as the buckled fold 15. This has therefore allowed each reflector surface 3-6 to be divided into a first part, generally denoted by 17, together with a second part and a third part generally denoted by 18 and 19 respectively, so that the part 17, along its respective buckled fold 7-10 against the base plane 2, can be bent down in relation to the base plane whilst the part 18 along the buckled fold 15 can be bent inwards in relation to the part 17, and the part 19 along the buckled fold 16 can be bent down in relation to the part 18. As a result, therefore, the corner edge, which is formed between two joined reflector surfaces adjoining one another along said edge when the radar reflector is in the opened state, will be leveled out when the radar reflector is in the folded state, which means that this, like the buckled fold, must be flexible.

Figure 3:
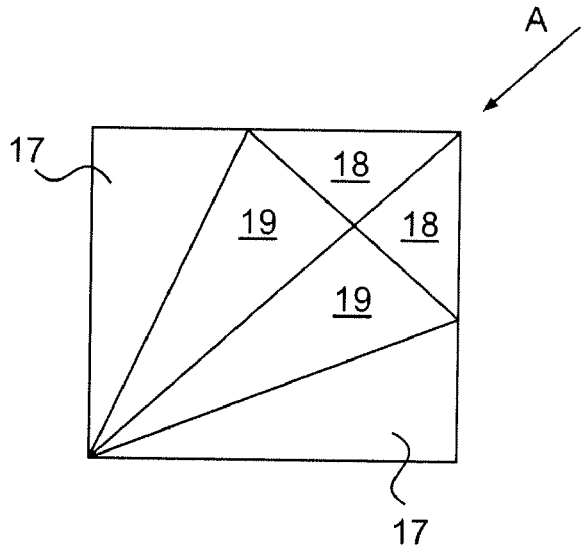
FIG. 3 shows the radar reflector according to FIG. 2 in the folded state prior to opening.
Figure 4:
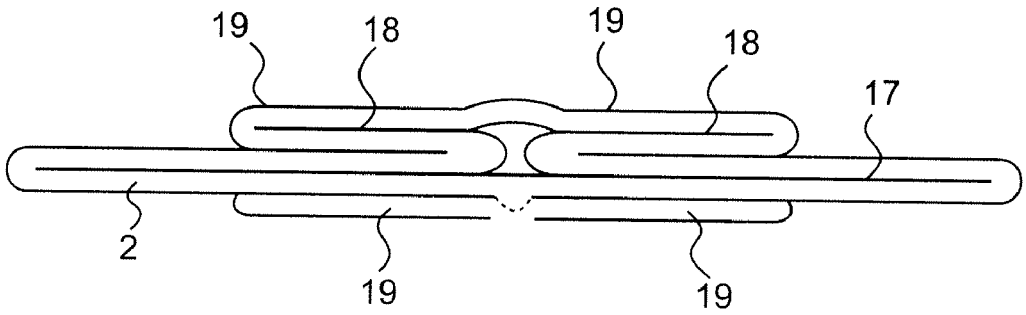
FIG. 4 shows the reflector according to FIG. 3 viewed in the direction of the arrow A.

The radar reflector according to the invention is shown in its folded, compacted state in FIGS. 3 and 4.

The invention claimed is:

1. A radar reflector deployable from an aircraft and that can be folded up prior to deployment and that opens automatically on deployment and flies freely after deployment, formed by bending and joining together an essentially planar sheet of radar wave-reflecting material, the radar reflector comprising:

an essentially square planar base having four edges;

four essentially square side reflectors, one side reflector extending from each edge of the base, each side reflector being bent upwards or downwards relative to the base along the edge between each side reflector and the base, such that side reflectors on opposite sides of the base are bent in opposite directions relative to the base, wherein with the radar reflector in an open state each side reflector is at essentially a right-angle to the base, each side reflector comprising edges, wherein edges of adjacent side reflectors bent in a same direction relative to the base are joined together, such that the joined adjacent side reflectors form a corner reflector, wherein each side reflector comprises an outwardly turned first buckled fold extending diagonally from a common inner corner where the joined edges of adjacent side reflectors and the base plane meet to an opposite outer corner of each side reflector, wherein each side reflector further comprises an inwardly turned second buckled fold extending from the common inner corner and dividing a portion of each reflector situated between the first buckled fold and the joined edges of the adjacent side reflectors into two parts that overlap and bear against each other with the reflector in a folded state.

2. The radar reflector according to claim 1, wherein the second buckled fold divides the portion of each reflector surface situated between the first buckled fold and the joined edges of the adjacent side reflector surfaces into two isogonal new parts.

3. The radar reflector according to claim 1, wherein the radar reflector comprises a sheet material affording good radar reflection, dimensional stability and good shape memory.

4. A method of forming a corner radar reflector, the method comprising:

providing a sheet of radar wave-reflecting material comprising a planar base having four edge sides, the sheet further comprising an essentially square side reflector extending from each edge side of the base, each side reflector comprising three free edge sides;

bending each side reflector upwards or downwards at essentially a right angle relative to the base along the edge side of the base, wherein the bending is carried out in the same direction at two adjoining edge sides of the base and in opposite directions along opposing edge sides of the base;

joining together adjacent edges of side reflectors bent in a same direction with respect to the base, such that the joined together side reflectors form a corner reflector;

creating in each side reflector an outwardly turned first buckled fold that extends diagonally from a common inner corner where the joined edges of the side reflectors and the base meet to an opposite outer corner of each side reflector; and creating in each side reflector an inturned second buckled fold that extends from the common inner corner and divides into two parts a portion of each side reflector situated between the first buckled fold and the jointed edges of the adjacent side reflectors, wherein the second buckled fold divides the part of each side reflector into two parts that will overlap and bear against each other when the reflector is in the folded state.

5. The method according to claim 4, wherein the second buckled fold divided the part of each side reflector into two isogonal parts.

6. The method according to claim 4, wherein in an opened state each side reflector is essentially square.

7. The method according to claim 4, wherein the outwardly turned first buckled fold is operative to allow the entire reflector to be folded up into a flat pack.

8. The method according to claim 4, wherein providing the sheet of radar wave-reflecting material comprises joining the side reflectors to the base.

9. The method according to claim 4, further comprising: deploying the reflector from an aircraft.

10. The method according to claim 9, further comprising: folding the reflector prior to deployment.

11. The method according to claim 10, wherein the reflector automatically opens upon deployment and flies freely after deployment.

* * * * *